US009123479B2

(12) United States Patent
Woodburn

(10) Patent No.: US 9,123,479 B2
(45) **Date of Patent: *Sep. 1, 2015**

(54) ACCESS DOOR WITH INTEGRATED SWITCH ACTUATOR

(71) Applicant: Intermec IP Corporation, Fort Mill, SC (US)

(72) Inventor: William Woodburn, Muscatine, IA (US)

(73) Assignee: Intermec IP Corporation, Fort Mill, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/571,452

(22) Filed: Dec. 16, 2014

(65) Prior Publication Data

US 2015/0096872 A1 Apr. 9, 2015

Related U.S. Application Data

(63) Continuation of application No. 13/771,980, filed on Feb. 20, 2013, now Pat. No. 8,916,789.

(60) Provisional application No. 61/701,211, filed on Sep. 14, 2012.

(51) Int. Cl.

| | |
|---|---|
| ***H01H 13/04*** | (2006.01) |
| ***H01H 3/16*** | (2006.01) |
| ***E05F 1/12*** | (2006.01) |
| ***E05D 1/02*** | (2006.01) |

(52) U.S. Cl.
CPC ..... *H01H 3/162* (2013.01); *E05D 1/02* (2013.01); *E05F 1/12* (2013.01); *H01H 2221/074* (2013.01)

(58) Field of Classification Search
CPC ..... E05D 1/02; E05F 1/12; H01H 9/287; H01H 2009/048; H01H 3/20; H01H 13/06; H02G 3/14
USPC ..... 200/333, 334, 293, 43.22, 50.03; 49/386, 506
See application file for complete search history.

(56) References Cited

U.S. PATENT DOCUMENTS

| | | | | |
|---|---|---|---|---|
| 5,055,642 | A * | 10/1991 | Miyata | 200/293 |
| 5,362,933 | A * | 11/1994 | Kutsche et al. | 200/401 |
| 5,434,376 | A * | 7/1995 | Hyatt et al. | 200/293 |
| 8,916,789 | B2 * | 12/2014 | Woodburn | 200/333 |
| 2013/0056338 | A1 * | 3/2013 | Dahl et al. | 200/293 |

* cited by examiner

*Primary Examiner* — Edwin A. Leon
(74) *Attorney, Agent, or Firm* — Additon, Higgins & Pendleton, P.A.

(57) ABSTRACT

An apparatus and method are disclosed for creating an integrated access door and switch actuator. The integrated access door and switch actuator are created from a single composite material. The composite material is flexible to allow movement, but is also durable to provide a protective covering. The integrated access door and switch actuator include a hinge, which allows the access door to move to an open and closed position while the switch actuator is stationary in a fixed position.

18 Claims, 3 Drawing Sheets

ACCESS DOOR WITH INTEGRATED SWITCH ACTUATOR

CROSS-REFERENCE TO RELATED APPLICATIONS

The present application claims the benefit of U.S. patent application Ser. No. 13/771,980 for an Access Door with Integrated Switch Actuator filed Feb. 20, 2013 (and published Mar. 20, 2014 as U.S. Patent Application Publication No. 2014/0075846), now U.S. Pat. No. 8,916,789, which claims the benefit of U.S. Patent Application No. 61/701,211 for an Access Door with Integrated Switch Actuator filed Sep. 14, 2012. Each of the foregoing patent applications, patent publication, and patent is hereby incorporated by reference in its entirety.

SUMMARY

Embodiments of the invention are defined by the claims below, not this summary. A high-level overview of various aspects of embodiments of the invention is provided here for that reason, to provide an overview of the disclosure and to introduce a selection of concepts that are further described below in the detailed description section. This summary is not intended to identify key features or essential features of the claimed subject matter, nor is it intended to be used as an aid in isolation to determine the scope of the claimed subject matter.

Embodiments of the present invention relate generally to a method and/or apparatus for integrating an access door and switch actuator. Accordingly, the present invention provides a single composite component that has a switch actuator in a fixed position and a hinged door that provides access to an internal area of a device.

BRIEF DESCRIPTION OF THE DRAWINGS

Illustrative embodiments of the present invention are described in detail below with reference to the included drawing figures, wherein.

DETAILED DESCRIPTION

Figure 1:
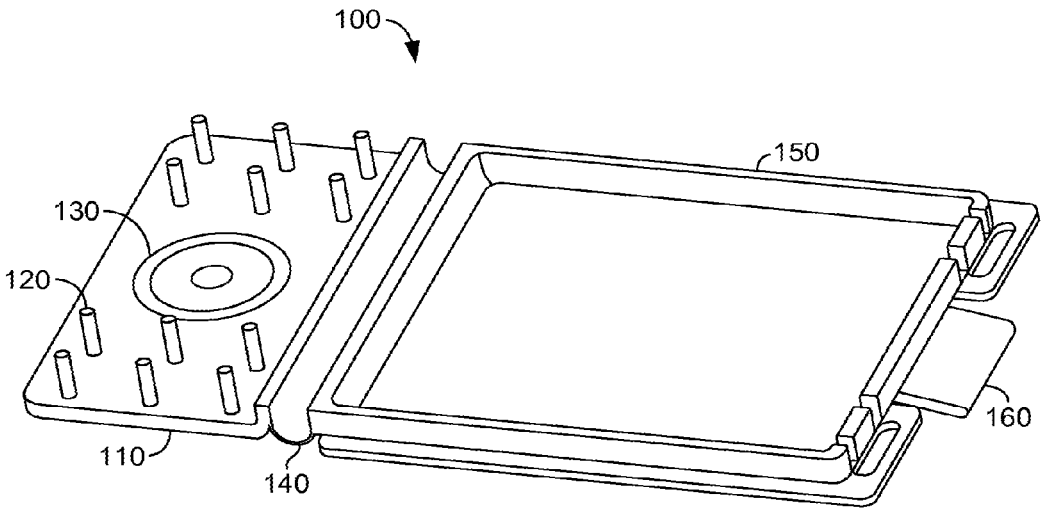
FIG. 1 is a perspective view of an integrated access door and switch actuator, in accordance with an embodiment of the present invention.

Embodiments of the present invention relate generally to a method and/or apparatus for integrating an access door and switch actuator. Accordingly, the present invention provides a single composite component that has a switch actuator in a fixed position and a hinged door that provides access to an internal area of a device.

The ability to activate a switch and have access to an item, such as a memory card, in one composite component is important. Rather than have two doors, one for a switch and one for access to electronic components, the present invention discloses one composite material to alleviate having multiple components or multiple materials.

The present invention provides an apparatus that integrates an access door and switch actuator. A rectangular shaped material ("first material") has a thin shape with substantially planar surfaces opposite each other. The first material is raised when placed in a fixed position. The first material, in the fixed position, operates to flex and make contact at one surface with an underlying surface, button, or switch when pressed from an opposite surface of the first material.

The first material is integrally connected to a living hinge at a first edge. The living hinge is made of the same material as the first material. The living hinge is integrally connected to another rectangular shaped material ("second material") at a second edge. The second material is made of the same material as the first material and the living hinge. The living hinge bends causing the second material to move in an angular direction along the second edge.

The second material has an attached mechanism located on an opposite edge of the second material from the second edge. The attached mechanism operates to lock and unlock the second material into and from the fixed position respectively. When the attached mechanism is manipulated to lock the second material in the fixed position, the second material is located in the same plane as the first material. When the attached mechanism is manipulated to unlock the second material from the fixed position, the second material swings in an angular direction pivoting along the second edge while the first material stays in the fixed position with the first edge.

In another embodiment, an integrated access door and switch actuator are created by forming a material into a substantial planar surface having at least three connected parts. A first part is shaped into a rectangular flat surface that has independent projections extending perpendicular from one side so as to form a raised surface when the first part is fixed into position. The independent projections are positioned toward the edges of the first part on the one side such that when the first part is in the fixed position, a center portion of the first part flexes and makes contact with an underlying surface when pressed from an opposite side of the first part. A living hinge is formed in a second part that is integrally connected to the first part along a first elongated edge of an arc formed by the living hinge and integrally connected to a third part along a second elongated edge of the arc formed by the living hinge such that the second part bends causing the third part to move when the first part is in the fixed position. The third part is formed into a shape of a door that has an attached mechanism to lock and unlock the third part into and from the fixed position respectively. The attached mechanism is located opposite to a location of the second part and the second elongated edge. When the attached mechanism is manipulated to unlock the third part from the fixed position, the third part swings along the second elongated edge of the second part while the first part stays in the fixed position with the first elongated edge of the second part.

Turning now to FIG. 1, a cover 100 is shown with a fixed portion 110, a living hinge 140, and an access door 150. Cover 100 is a single composite material that is pliable but durable enough to provide protection. In some embodiments, the composite material is made of plastic, such as polypropylene or polyethylene. In other embodiments, the composite material is made of rubber. Fixed portion 110 can be fixed in position to act as a covering for a switch or button. Fixed portion 110 has a set of posts 120 that can be referred to as projections or protrusions. The set of posts 120 extend perpendicularly from the surface of fixed portion 110 so that when fixed portion 110 is placed in a fixed position, the set of posts 120 provide support to place fixed portion 110 in a raised, fixed position. In other words, fixed portion 110 acts as a raised surface. Further, posts 120 are located only on one side of fixed portion 110.

In another implementation of an embodiment of the present invention, posts 120 are heat stake posts that are molded from the material of cover 100. In this embodiment, posts 120 do not provide support as in other embodiments, but are created in a molding process. Posts 120 are threaded through holes in the device where cover 100 is located, such as a computer housing. Posts 120 are swaged or formed using heat to permanently fix fixed portion 110 to the computer housing. After the heat stake operation, fixed portion 110 is permanently attached to the device, such as a computer.

Posts 120 can be reshaped to become ultrasonic weld features. Ultrasonic weld features can be generalized as tabs that melt into slightly undersized slots due to the heat of friction caused by vibrations induced ultrasonic frequencies. Ultrasonic welds between plastic parts can be achieved with tabs and slots, pins and holes, or triangular-shaped features and a flat surface. In other embodiments, fixed portion 110 can be attached to the device using adhesive (tape or liquid) or mechanical fasteners, like screws or a fabric hook-and-loop fastener, like Velcro®.

Fixed portion 110 includes an actuator 130 that is located in the center or near the center of fixed portion 110. Actuator 130 is used to provide a user with a mechanism and visual reference to activate an underlying, but separate switch or button. Or, actuator 130 is used to establish contact with an underlying surface. For example, as fixed portion 110 is located in a fixed position, a user can press the surface of fixed portion 110 causing fixed portion 110 to flex, resulting in actuator 130 making contact with the underlying surface, switch, or button. To accomplish this feat, the set of posts 120 are spaced so that there is enough room for fixed portion 110 to bend and allow actuator 130 to come into contact with the adjacent surface. In some embodiments, the set of posts 120 are spaced along the edges so as to not hamper the movement of fixed portion 110 when it is pressed. Fixed portion 110 can bend or flex in order to make contact between actuator 130 and the surface, switch, or button underneath. In another embodiment, the set of posts 120 are spaced circumferentially around a center area so that there is space near the center of fixed portion 110. In yet another embodiment, the set of posts 120 are spaced in parallel rows located near two parallel edges of fixed portion 110. The spacing is arranged so that there is an area down the middle where no posts are located. In that area, actuator 130 is located.

Fixed portion 110 is connected to living hinge 140, and living hinge 140 is connected to access door 150. Living hinge 140 is shaped in the form of an arc or partial cylinder. Living hinge 140 provides flexibility and can bend easily. When in an unrestrained position, living hinge 140 allows access door 150 to move or swing in an angular direction with minimum or no external force exerted on access door 150. Because of the arc shape in living hinge 140, both fixed portion 110 and access door 150 can move about the axis of living hinge 140. However, in most embodiments, fixed portion 110 remains in a fixed position leaving only access door 150 having the capability of moving in conjunction with living hinge 140.

As access door 150 can pivot around living hinge 140, in some embodiments, access door 150 may be placed in a fixed position along with fixed portion 110. In such situation, it may be necessary to secure access door 150 so that it does not move. Under such circumstances, access door 150 can include a locking mechanism 160. Locking mechanism 160 allows access door 150 to be locked into a fixed position. For example, access door 150 may act as a covering for electronic components on a mobile device. Access door 150 can be secured in place with locking mechanism 160. Likewise, locking mechanism 160 can be manipulated to unlock and release access door 150. Although an exemplary version of locking mechanism 160 is shown in FIG. 1, other embodiments may implement locking mechanism 160 in another form. For example, locking mechanism may have a clasp, clip, or latch. In another example, locking mechanism 160 may be a screw that seals access door 150 shut. In yet another example, locking mechanism 160 may be a removable fastener.

Figure 2:
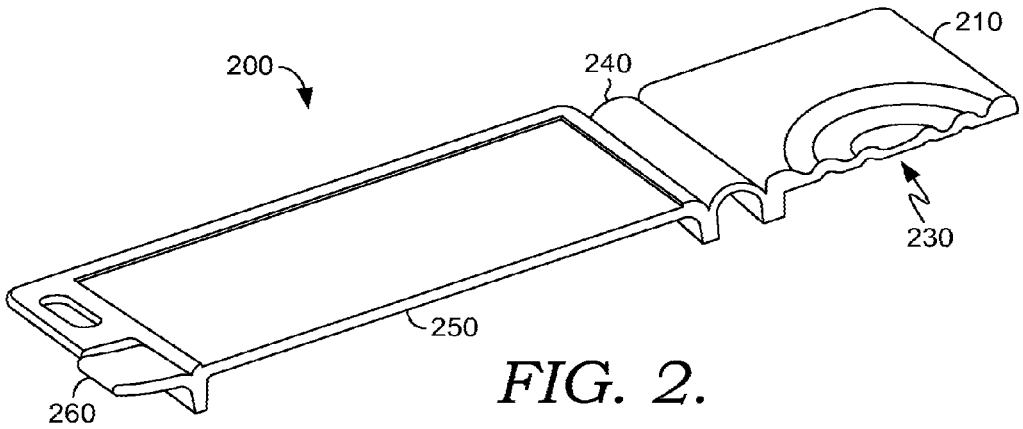
FIG. 2 is a cross-sectional view of an integrated access door and switch actuator, in accordance with an embodiment of the present invention.

Overall, FIG. 1 depicts the bottom side of cover 100 in the perspective view. As described above, fixed portion 110 is positioned so that the unseen side of cover 100 becomes visible to a user. As depicted in FIG. 2, a cross-sectional view of cover 100 is shown as cover 200. However, cover 200 shows the cross-section as well as the opposite side of cover 100. In FIG. 2, cover 200 depicts a fixed portion 210 connected to a living hinge 240, which is connected to an access door 250. All of the items described in cover 200 are similar to the items described in cover 100 in FIG. 1, but only depicted in a cross-sectional form. Fixed portion 210 includes an actuator 230 which resembles a button or area where a user may press. When fixed portion 210 is in a fixed position, the user may press the area where actuator 230 is located to cause fixed portion 210 to flex or bend until the underside of actuator 230 touches the underlying surface, switch, or button. Further, as shown in FIG. 2, the user is provided a pictorial area where actuator 230 is located so that the user may know where to place his or her finger. This pictorial area can be several concentric circles. However, in other embodiments, actuator 230 may not be easily depicted. Actuator 230 may not have a pictorial representation, but may be a smooth area on the surface of fixed portion 210.

Like in FIG. 1, fixed portion 210 is made from a composite material that enables fixed portion 210, living hinge 240, and access door 250 to be made in one piece. Because of this design, living hinge 240 can flex or bend to allow access door 250 to swing or pivot around an axis. Cover 200 is flexible and durable to allow access door 250 to move from a fixed planar position with fixed portion 210 to an angular position. Further, access door 250 may be secured or locked into position by a locking mechanism 260, similar to locking mechanism 160 described in FIG. 1. The cross-sectional view of cover 200 illustrates the single piece composite design of cover 100. For example, rather than have multiple access doors on a mobile device, cover 100 and cover 200 illustrate a single piece of material with multiple functions and uses.

Figure 3:
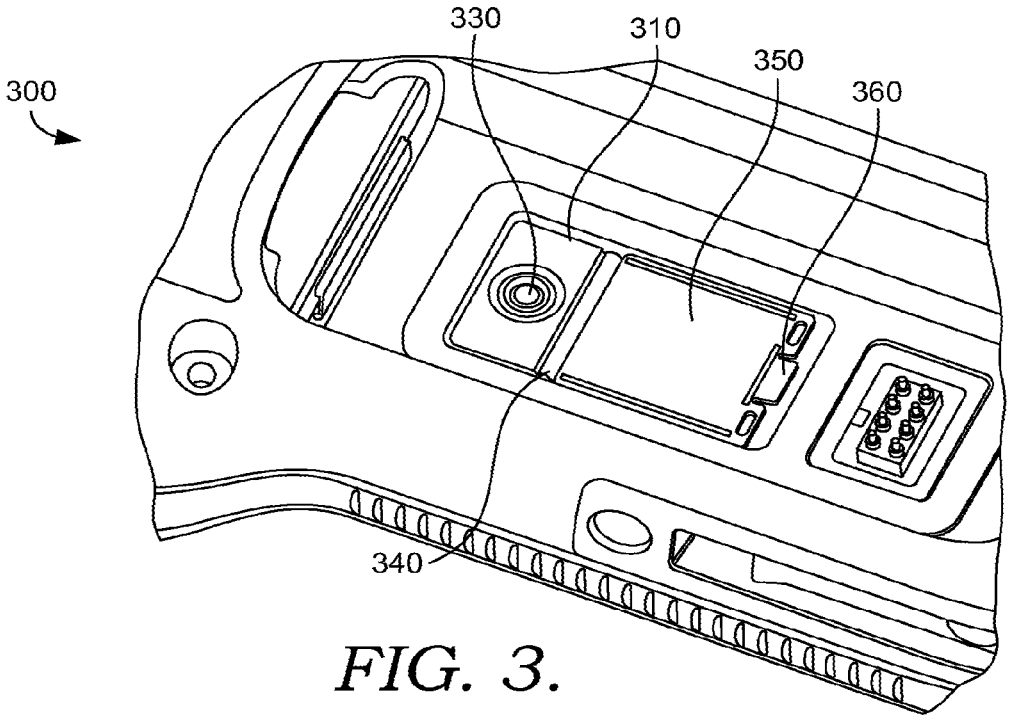
FIG. 3 is a context view of an integrated access door and switch actuator in a closed position implemented in a mobile device, in accordance with an embodiment of the present invention.

Turning now to FIG. 3, an illustrated view of an integrated access door and switch actuator is shown in device 300. Device 300 may be a mobile device or any other handheld device. In some embodiments, device 300 includes a cover 300 that is located on the back of device 300. Particularly, mobile devices have compartments that hold a battery and other components. These mobile devices may have a compartment that hides sensitive electronics and may also have a reset button that allows a user to reset the device. For example, in FIG. 3, a user can access cover 300 on the back of device 300 probably by removing a cover (not shown). Once the cover is removed, the battery may be removed exposing cover 300, which is depicted. The user may need to reset device 300 by pressing a switch actuator 330, which is located on a fixed portion 310. Fixed portion 310 is aptly named because a manufacturer may prefer to give the user the ability to reset the device, but not give the user the ability to remove the cover to gain access to the underlying switch or button.

As described above, the user can press actuator 330 causing fixed portion 310 to flex or bend to touch either a switch or button. The touching action may be a reset function, which can reset the phone. In another embodiment, a switch or button may not be implemented. Instead, there may be two metallic surfaces, one metallic surface on the underside of actuator 330, which is also the underside of fixed portion 310, and another metallic surface slightly underneath. Remember, as described above in FIG. 1, the spacing between the two surfaces will be established by the size and length of the posts 120, which extend out from fixed portion 310. However, in FIG. 3, the posts 120 cannot be seen as they are sealed underneath. Anyway, when the user presses actuator 330, this action causes fixed portion 310 to flex or bend and the two surfaces touch, resulting in an electrical connection that can cause a reset of device 300.

Further, fixed portion 310 is connected to a living hinge 340, which is also connected to an access door 350. As one can see, fixed portion 310, living hinge 340, and access door 350 are positioned in the same plane, primarily a closed position. Access door 350 is held in the closed position by a locking mechanism 360. Locking mechanism can be manipulated by the user to open access door 360 without opening or disturbing fixed position 310. This is done by the use of living hinge 340, which provides the bending or flexing capability that allows access door 350 to move or swing open.

Figure 4:
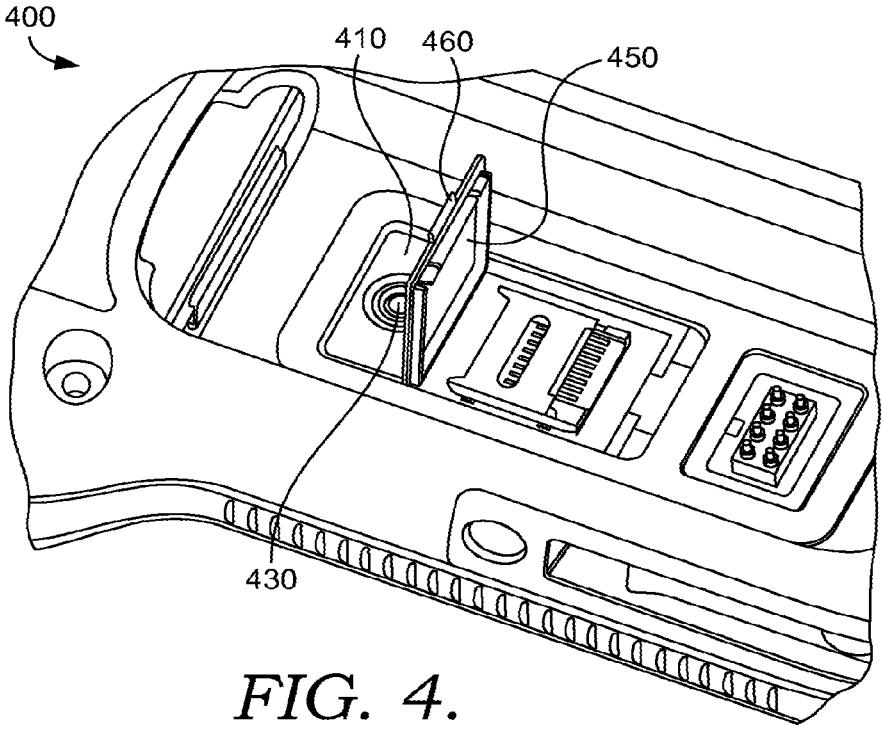
FIG. 4 is a context view of an integrated access door and switch actuator in an open position implemented in a mobile device, in accordance with an embodiment of the present invention.

As shown in FIG. 4, device 400 is the same as device 300. Fixed portion 410 is similar to fixed portion 310. Actuator 430 is similar to actuator 330. However, device 400 shows access door 450 in an open position as opposed to the closed position shown by access door 350 in FIG. 3. The ability of access door 450 to swing open to the position shown is made possible by a living hinge (not shown), similar to living hinge 340. Further, access door 450 includes a locking mechanism 460 similar to locking mechanism 360. As one can see, all of the components, either in FIG. 3 or FIG. 4, are made from a single composite material. Such design reduces the amount of material involved, reduces the need for a spring, and makes it easier for the item to be installed.

As shown in the various embodiments, the piece-part count is reduced by the single design of the present invention.

Figure 5:
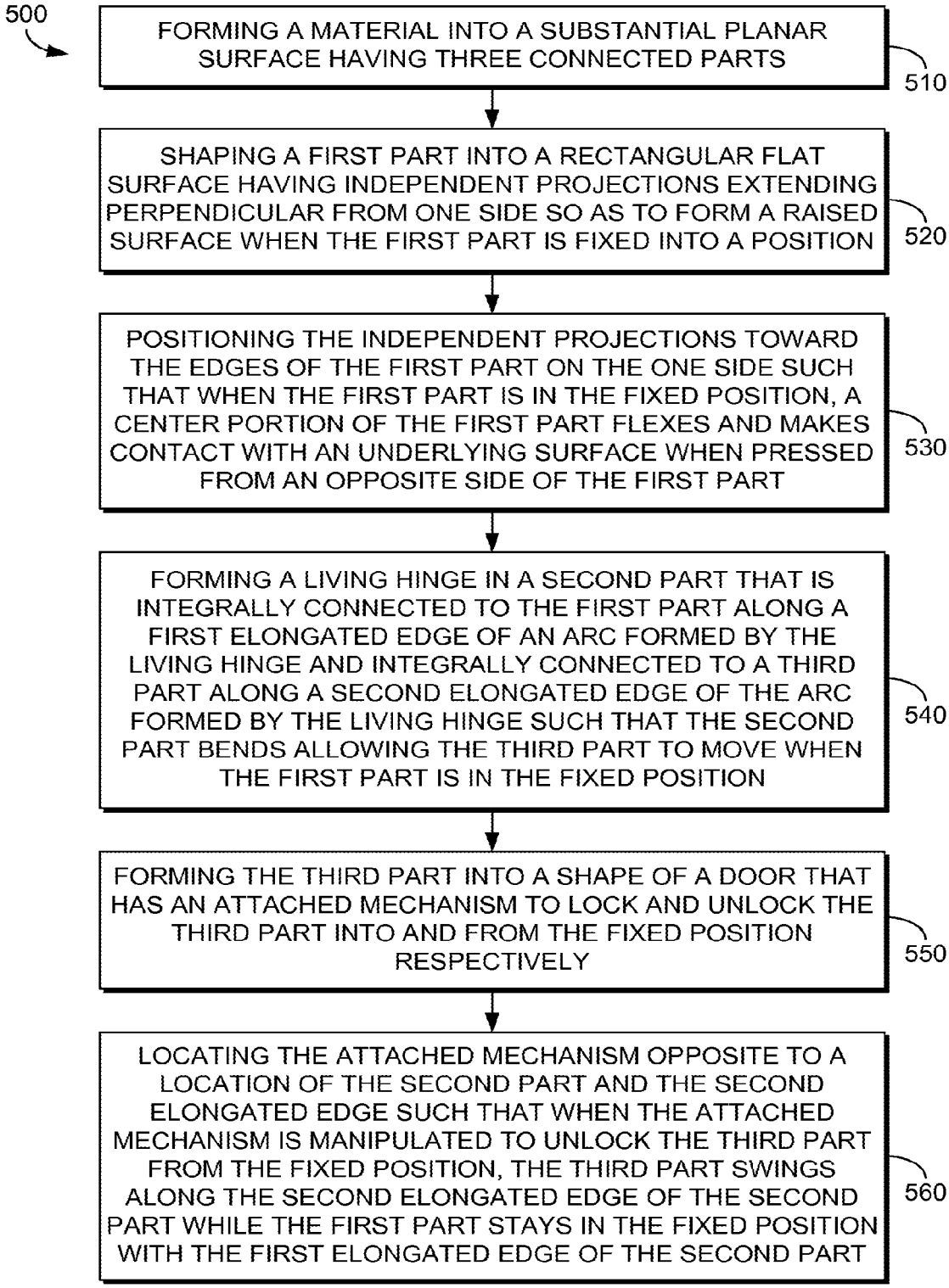
FIG. 5 is a process for creating an integrated access door and switch actuator, in accordance with an embodiment of the present invention.

Turning now to FIG. 5, a process for creating an integrated access door and switch actuator is shown in a method 500. In a step 510, cover 100 is formed into a substantial planar surface having three connected parts, fixed portion 110, living hinge 140, and access door 150. In a step 520, fixed portion 110 is shaped into a rectangular flat surface having posts 120 extending perpendicular from one side so as to form a raised surface when fixed portion is fixed into a position. In a step 530, posts 120 are positioned toward the edges of fixed portion 110 on the one side such that when fixed portion 110 is in the fixed position, actuator 130 of fixed portion 110 flexes and makes contact with an underlying surface when pressed from an opposite side of fixed portion 110. In a step 540, living hinge 140 is integrally connected to fixed portion 110 along a first elongated edge of an arc formed by living hinge 140. Living hinge 140 is also integrally connected to access door 150 along a second elongated edge of the arc formed by living hinge 140. As a result, living hinge 140 can bend allowing access door 150 to move when fixed portion 110 is in the fixed position. In a step 550, access door 150 is formed into a shape of a door that has a locking mechanism 160 to lock and unlock access door 150 into and from the fixed position respectively. In a step 560, locking mechanism 160 is located opposite to a location of living hinge 140 and the second elongated edge such that when locking mechanism 160 is manipulated to unlock access door 150 from the fixed position, access door 150 swings along the second elongated edge of living hinge 140 while fixed portion 110 stays in the fixed position with the first elongated edge of living hinge 140.

Many different arrangements of the various components depicted, as well as components not shown, are possible without departing from the spirit and scope of embodiments of the present invention. Embodiments of the present invention have been described with the intent to be illustrative rather than restrictive. Certain features and subcombinations are of utility and may be employed without reference to other features and subcombinations and are contemplated to be within the scope of the claims.

The invention claimed is:

1. An apparatus integrating an access door and switch actuator, comprising:

a shaped material having a thin shape with substantially planar surfaces opposite each other, wherein the shaped material is raised when placed in a fixed position;

the shaped material, in the fixed position, operable to flex and make contact at one surface with an underlying surface, button, or switch when pressed from an opposite surface of the shaped material;

the shaped material integrally connected to a hinge at a first edge, wherein the hinge is made of a same material as the shaped material;

the hinge integrally connected to another shaped material at a second edge, wherein the another shaped material is made of the same material as the shaped material and the hinge, and wherein the hinge bends causing the another shaped material to move in an angular direction along the second edge;

the another shaped material having an attached mechanism located on an opposite edge of the another shaped material from the second edge, the attached mechanism operable to lock and unlock the another shaped material into and from the fixed position respectively;

wherein when the attached mechanism is manipulated to lock the another shaped material into the fixed position, the another shaped material is located in a same plane as the shaped material; and wherein when the attached mechanism is manipulated to unlock the another shaped material from the fixed position, the another shaped material swings in an angular direction pivoting along the second edge while the shaped material stays in the fixed position with the first edge.

2. The apparatus of claim 1, wherein the shaped material has a set of posts extending perpendicularly from one surface, where the set of posts is spaced so as to contain no posts in proximity to a center area of the one surface of the shaped material.

3. The apparatus of claim 2, wherein the set of posts is spaced circumferentially around the center area of the one surface.

4. The apparatus of claim 2, wherein the set of posts is spaced towards opposite edges so as to leave a void of posts in the center area of the one surface.

5. The apparatus of claim 2, wherein the same material is a flexible plastic.

6. The apparatus of claim 5, wherein the flexible plastic is polypropylene or polyethylene.

7. The apparatus of claim 2, wherein the same material is rubber.

8. A method for creating an integrated access door and switch actuator, comprising:

forming a material into a substantial planar surface having at least three connected parts;

shaping a first part into a flat surface that has a series of independent projections extending perpendicularly from one side so as to form a raised surface when the first part is fixed into a position;

positioning the series of independent projections toward the edges of the first part on the one side such that when the first part is in the fixed position, a center portion of the first part flexes and makes contact with an underlying surface when pressed from an opposite side of the first part;

forming a hinge in a second part that is integrally connected to the first part along a first elongated edge of an arc formed by the hinge and integrally connected to a third part along a second elongated edge of the arc formed by the hinge such that the second part bends allowing the third part to move when the first part is in the fixed position; and forming the third part into a shape of a door that has an attached mechanism to lock and unlock the third part into and from the fixed position respectively, wherein the attached mechanism is located opposite to a location of the second part and the second elongated edge, such that when the attached mechanism is manipulated to unlock the third part from the fixed position, the third part swings along the second elongated edge of the second part while the first part stays in the fixed position with the first elongated edge of the second part.

9. The method of claim 8, wherein the material is a flexible plastic.

10. The method of claim 9, wherein the flexible plastic is polypropylene or polyethylene.

11. The method of claim 8, wherein the material is rubber.

12. The method of claim 8, wherein the underlying surface is a switch or button that is actuated when placed in contact with the first part.

13. A method for creating an integrated access door and switch actuator, comprising:

forming a material into a substantial planar surface having at least three connected parts;

shaping a first part into a flat surface that sits fixed into a position;

forming a hinge in a second part that is integrally connected to the first part along a first elongated edge of an arc formed by the hinge and integrally connected to a third part along a second elongated edge of the arc formed by the hinge such that the second part bends allowing the third part to move when the first part is in the fixed position; and forming the third part into a shape of a door that has an attached mechanism to lock and unlock the third part into and from the fixed position respectively, wherein the attached mechanism is located opposite to a location of the second part and the second elongated edge, such that when the attached mechanism is manipulated to unlock the third part from the fixed position, the third part swings along the second elongated edge of the second part while the first part stays in the fixed position with the first elongated edge of the second part.

14. The method of claim 13, further comprising:

implementing a series of independent projections extending perpendicularly from one side of the first part so as to form a raised surface when the first part is fixed into a position; and positioning the series of independent projections toward the edges of the first part on the one side such that when the first part is in the fixed position, a center portion of the first part flexes and makes contact with an underlying surface when pressed from an opposite side of the first part.

15. The method of claim 14, wherein the material is a flexible plastic.

16. The method of claim 15, wherein the flexible plastic is polypropylene or polyethylene.

17. The method of claim 14, wherein the material is rubber.

18. The method of claim 14, wherein the underlying surface is a switch or button that is actuated when placed in contact with the first part.

* * * * *